US005597300A

United States Patent [19]

Wohl et al.

[11] Patent Number: 5,597,300

[45] Date of Patent: Jan. 28, 1997

[54] CANDLE AND PROCESS FOR ITS MANUFACTURE

[76] Inventors: Michael C. Wohl, 1512 Windham La., Silver Springs, Md. 20902; Stephen G. Schulhoff, 107 W. Monument St., #3A, Baltimore, Md. 21201

[21] Appl. No.: 328,986

[22] Filed: Oct. 25, 1994

[51] Int. Cl.[6] ..... F23D 3/16

[52] U.S. Cl. ..... 431/288; 431/289; 425/803

[58] Field of Search ..... 431/288, 289; 425/803

[56] References Cited

U.S. PATENT DOCUMENTS

| | | | |
|---|---|---|---|
| 1,660,760 | 2/1928 | Murphy . | |
| 3,388,960 | 6/1968 | Cangialosi | 431/288 |
| 3,411,856 | 11/1968 | Crumrine | 431/288 |
| 3,744,957 | 7/1973 | Wright, Sr. . | |
| 4,304,547 | 12/1981 | Buzil . | |
| 4,507,077 | 3/1985 | Sapper | 431/288 |
| 4,519,310 | 5/1985 | Shimizu et al. . | |
| 4,543,883 | 10/1985 | Skrypek et al. . | |
| 4,568,270 | 2/1986 | Marcus et al. | 431/288 |
| 4,797,090 | 1/1989 | Rogers . | |
| 5,123,345 | 6/1992 | Wood . | |
| 5,264,995 | 11/1993 | McKee . | |

OTHER PUBLICATIONS

Photograph of Four (4) Candles (undated).

Brochure entitled "The Glowing Candle 1994 Spring Collection" (undated).

*Primary Examiner*—Carroll B. Dority

*Attorney, Agent, or Firm*—Pennie & Edmonds

[57] ABSTRACT

A candle is made of a plurality of high melting point wax outer layers surrounding an inner core of consumable wax, thereby creating a reusable candle with a replaceable core. The candle is cast as a sequence of outer layers, then filled with a core of consumable wax and a wick. It can display an image combining an applied graphic on its outer surface aligned with the colored layers, the combination of which can be lit by light from the candle flame passing through the outer layers of the candle.

23 Claims, 3 Drawing Sheets

CANDLE AND PROCESS FOR ITS MANUFACTURE

BACKGROUND OF THE INVENTION

The present invention relates to candles and processes for their manufacture, and more specifically, to candles having a flame consumable core with a non-consumable outer shell.

Candles are an ancient item of manufacture and an article of artistic handiwork. Throughout the centuries people have enjoyed the flickering light of candles cast into a room, and the warm glow transmitted through a candle's translucent walls.

To accentuate the appearance of candles, images have been engraved, inscribed and painted on their outer surfaces so they would not only emit light, but display images or patterns as light passes through their outer walls.

Such candles, intended as much for decoration as for shedding light, are generally non-colored or lightly colored candles and have a relatively large cross-sectional diameter. As the wick burns in the central core of the candle, an outer wall is left standing through which the light from the wick shines, illuminating the images or patterns in the outer walls.

There are drawbacks to these candles, however. Walls of thick candles do not melt evenly, leaving thick areas and thinner areas that vary the amount of light passing through. As wicks burn, they often tilt to one side, causing the walls to melt through and wax to run out. When a thick-walled candle burns, the walls often slump or collapse, distorting any image it is designed to present, and sometimes melting a hole through the wall and the image, presenting a ragged or drooping top candle rim that many found unsightly. When a thick-walled candle is burned through, this outer drooped shell is left and is of no value, since it cannot be effectively reused without remelting. The amount of colorant (usually a dye) in the candle wax that is necessary to give the candle a visually attractive color when the candle is unlit unfortunately blocks light transmission when the candle is lit.

To address these problems, candles have been created that have more than one portion (typically two): an outer shell of relatively high melting point wax and an inner core of relatively low melting point translucent wax. The inner core is designed to melt and burn, and the outer shell is designed to remain rigid and unmelted. If the melting point of the waxes, the diameter of the inner and outer layers, and the size of the wick are chosen properly, the inner, lower melting point core of a candle can be burned away, leaving a smooth outer shell wall with a well preserved inner surface substantially as originally manufactured.

U.S. Pat. No. 4,225,552 is one example of a two portion candle having a higher melting point outer shell and an inner core of lower melting point consumable wax. This reference discloses a method of manufacturing a candle by affixing wax flowers of various colors to a wax core, then encasing this structure in a shell of higher melting point wax. The process described in the '552 patent primarily involves two steps: creating an inner core, then encasing the core in an outer shell of higher melting point wax. One drawback of this process is the need to affix devices to the outer wall in order to create a multicolored shell.

U.S. Pat. No. 3,886,252 discloses another candle with a higher melting point outer shell and a lower melting point inner core. This patent discloses a multi-step method of making a highly textured outer shell of wax that duplicates a vase, candle holder or some similar three dimensional structure, then filling this with consumable candle wax. The steps in creating the shell are complex, involving rotating a cylindrical mold, partially filling the mold with wax, and allowing the cooling wax to solidify and build up in layers on the inner surface of the mold, thereby creating a hollow outer shell.

This method is particularly useful in duplicating the surface texture of a deeply relieved structure, such as a cut glass vase, candleholder or the like. A serious drawback is the necessity of using mold rotating machinery, the required space for this equipment, and the length of time required to cool the wax in order to create a hollow outer shell of the right thickness. It is also incapable of producing a plurality of differently colored longitudinally disposed layers. A single layer is produced along the entire length of the inner surface.

A different method of making and decorating a core-and-shell candle would be advantageous. A method that reduced the time, equipment and effort required would allow higher rates of production with a smaller investment of labor and capital.

It is therefore an object of this invention to provide a better method of manufacture for a core-and-shell candle. It is a further object of this invention to provide a core-and-shell candle that glows. Additionally in this regard, it is also an object to provide a candle that is made of at least two waxes with different melting points wherein the outer shell resists melting and is therefore reusable.

It is another object of this invention to provide a new mold design for such candles. Further in this regard, it is an object to provide an inexpensive mold design that is easily assembled and disassembled. It is a further object in this regard to provide a mold that need not be rotated to provide a hollow internal cavity.

It is yet another object of this invention to provide a method of decorating a candle that integrates translucent colored layers of said candle with an image applied on the outer surface to thereby provide a more visually appealing candle.

SUMMARY OF THE INVENTION

The present invention relates to a candle having an outer shell of wax with a first and second layer, where the layers are longitudinally disposed along the central axis of the candle, an inner core of consumable wax surrounded by the outer shell of wax, the inner core having an upper surface exposed through an aperture in the first layer; and a wick embedded in said inner core. Preferably, the outer shell has a melting point higher than the melting point of the inner core. The first layer is located at the top of the candle, has a first melting point, and has a first aperture through which the inner core is exposed; the second layer is at the bottom of said candle, has a second melting point, and has a second aperture. The first aperture is smaller than the second aperture.

The first melting point is also higher than the second melting point—the first melting point is between 145 and 160 degrees Fahrenheit and the second melting point is between 135 and 145 degrees Fahrenheit.

In one embodiment, the first aperture is formed by a spacer. Other embodiments feature a plurality of apertures in the first layer. The upper surface of the inner core may be recessed within the aperture.

This invention also relates to a mold for making an outer shell of a candle including an outer mold for forming an outer surface of the outer shell; an inner mold for forming an inner surface of the outer shell, which is located inside of the outer mold and is substantially spaced apart from the inner wall of the outer mold; and a means for spacing the inner mold and outer mold, where the means for spacing extends between the bottom of the inner mold and the bottom of the outer mold, and has a smaller area than an area of the bottom of the inner mold. In one embodiment the outer mold is a clear polymeric material, such as polyethylene. The outer mold is tapered between 1 and 15 degrees in one embodiment.

The means for spacing may be a bung passing through the bottom of the outer mold, it may be made of low durometer polymeric material, and it may be substantially concentric with the inner and outer molds. The bung may be adjustable to provide a variable friction fit between the bung and the aperture in the bottom of the outer mold, and the variable friction fit may be varied by tightening a screw fastener.

This invention also relates to a flattener for flattening an outer shell of a candle, which includes a heated plate, an elongate member connected to the heated plate and extending substantially vertically above the heated plate; and a candle support mounted to the elongate member having a top surface adapted to support the outer shell. The candle support may be threadedly engaged to the elongate member.

The invention also relates to a method of casting a candle including the steps of casting a first layer of an outer shell of the candle having a first aperture, from a first wax material having a first melting point; casting a second layer of the outer shell having a second aperture, from a second wax material having a second melting point, where the second layer is in contact with said top layer, and where the second melting point is less than said first melting point; and casting an inner core of the candle (extending into the first and said second apertures) from a third wax material having a third melting point, wherein the third melting point is less than the second melting point.

The method of casting the candle may also include the step of casting a base in the outer shell before the step of casting an inner core, or the step of heating the first wax material to a temperature between 240 and 260 degrees Fahrenheit before the step of casting said first layer, or the step of heating the second wax material to a temperature between 200 and 230 degrees Fahrenheit before the step of casting said second layer, or the step of flattening a bottom of the outer shell before the step of casting a base, or the step of printing an image on the surface of said outer shell aligned with said first and second layers. The invention also relates to a candle image on a candle made of a plurality of differently colored, translucent, substantially horizontal bands of wax; a graphic applied to the outer surface of the candle and covering the horizontal bands of wax; where the graphic and the bands are aligned to present a single integrated image.

DETAILED DESCRIPTION OF THE INVENTION

Figure 1A:
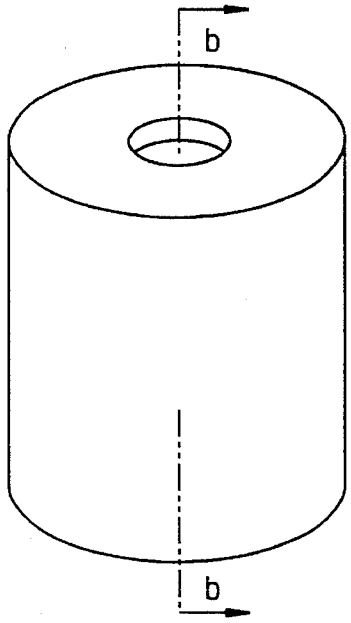
FIGS. 1 (*a*) and (*b*) illustrate a candle in perspective and cross-sectional views.
Figure 1B:
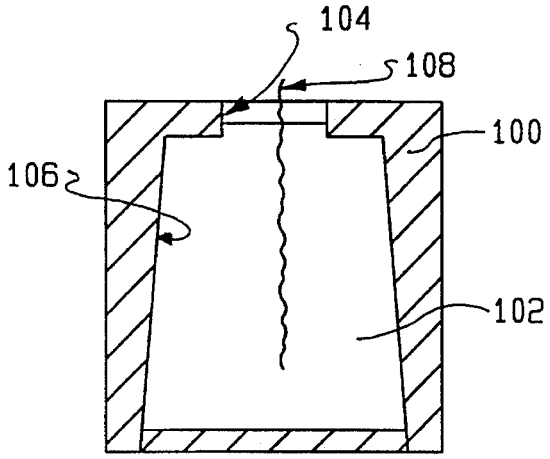
Figure 2A:
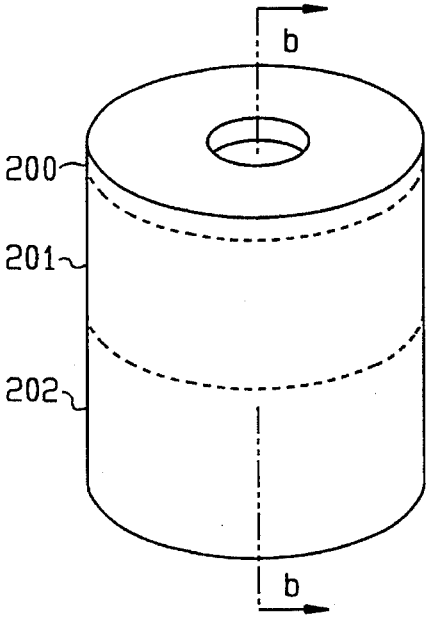
FIGS. 2 (*a*) and (*b*) illustrate another candle in perspective and cross-sectional views.
Figure 2B:
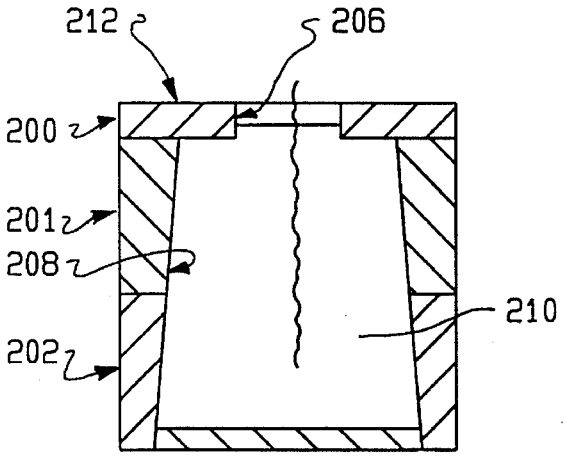

FIGS. 1 and 2 disclose two embodiments of candles in accordance with the present invention.

FIG. 1 (*a*) and (*b*) show a candle made of two layers, a higher melting point outer shell 100 and an inner core of lower melting point wax 102. The outer shell is typically made of wax with a high enough melting point that it will resist burning or melting by the wick, and thus preserve the shape of the outer shell. In this embodiment, the inner core is burned away when the wax is lit leaving the higher melting point shell intact. Unlike thick prior art candles which were not reusable because they slumped and melted as the wick burned, the present design is reusable, since outer shell is rigid, and the candle can either be refilled with more molten wax and a new wick, or a smaller candle (such as the commonly available "votive" candle) inserted in place of the burned out wick and wax. The outer shell is typically colored and the inner core made of transparent wax so the light from the wick burning in the center will be transmitted through the molten transparent wax and be further transmitted through the colored walls of the outer shell, causing the candle to glow through its outer shell. FIG. 1(*b*) also discloses two apertures, a first aperture 104 at the top of the candle, having a smaller diameter than a second aperture 106 in the lower part of the candle. Both apertures are shown as circular here, but can have a variety of shapes, such as polygonal, star shaped, oval or the like. The top free surface of inner core 102 is recessed within the well hole. With a recessed inner core, the candle shines through the pigmented wall of outer core 100 almost immediately after the wick 108 is lit.

FIG. 2(*a*) shows a candle having a plurality of outer layers 200–202 surrounding an inner core 210. In this embodiment, the outer layers 200–202 are concentric rings, oriented in successive distinct longitudinal positions about the central axis of the candle, each sharing a common flat planar surface with the adjacent layers, wherein substantially all of the surfaces are parallel, and wherein each of the layers is of substantially constant thickness measured in a direction perpendicular to each of the common planar surfaces. They are here shown as circular in axial cross section, but need not be. In the preferred embodiment, layers 200–202 are made of differently colored waxes. The differently colored layers are especially advantageous when they are combined and aligned with a graphic applied to the outer surface. FIG. 2(*a*) shows the effect of the alignment between colored layers and surface graphic. The colored layers 200–202 in combination with an image on the surface of the outer shell provide a combined integrated image. In the FIG. 2 embodiment an image of a surfer is displayed on the surface of the candle, and the colored bands appear to be the blue sky above the surfer (layer 200), the green ocean on which she is surfing (layer 201), and the tan beach in front of the surfer (layer 202). By integrating the applied image (the surfer) in the foreground with the colored bands in the background, the image can be made especially appealing to the viewer. As might be expected, alignment between the colored bands and the applied image is critical to the appearance of the candle. An image showing a surfer surfing on a tan beach, for example, would make no sense.

The image appearing on the surface (the surfer, in the FIG. 2 example) can be applied to the surface in liquid form such as by airbrushing, silkscreening, painting, or printing. Applicants have discovered that silkscreening or bottle printing are particularly good methods for applying the image in liquid form. The image appearing on the surface can also be applied in solid form, such as in the form of a decal or applique.

Once applied, the image can be protected by coating the candle in plastic, a high melting point wax (such as beeswax), or a wax with a high plastic content. These materials provide a smooth surface finish and protect any image applied on the surface from being smeared, smudged or scratched.

As shown in FIG. 2(*b*), this embodiment has a large inner core, most commonly circular in cross-section. It is typically smaller in cross-section at the top aperture 206 than the size of the aperture in the middle 208 or at the bottom 210. This has several advantages: by opening out into a large internal cross-section, there is more consumable wax inside and thus the candle has a longer life, furthermore, the line between layers in the outer shell is sharp, thus making a crisper image. By making a well hole of narrower cross-section in upper colored layer 200 more light is transmitted through the candle immediately upon lighting; by thinning the outer decorative layers of the outer shell, the outer shell will appear highly colored when unlit, yet still transmit enough light when the wick is lit to produce a highly colored glow.

Outer layer 200 in FIG. 2(*a*) is preferably made with a higher melting point wax than outer layers 201 or 202. It is beneficial to provide layers 200–202 with different melting point waxes for several reasons. First, since the cross-sectional area of well hole 206 forming the inner core is smaller for layer 200 than for layers 201 and 202, the wick is closer to the wax of outer layer 200 and tends to melt it more than it tends to melt layers 201 and 202. By using a wax with a higher melting point, layer 200 resists such melting. By using a lower melting point wax for layers 201 and 202, the cost can be reduced, since lower melting point waxes are generally more inexpensive. Higher melting point waxes may cost 20% more than lower melting point waxes. Third, by using the first higher melting point composition for layer 200, as disclosed below, bubble formation is inhibited on the upper surface of the candle, thereby providing a much smoother and visually appealing top surface.

Figure 3A:
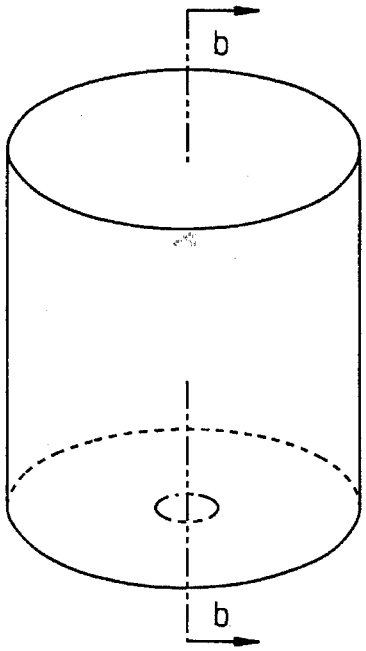
FIG. 3 (*a*) and (*b*) illustrate an outer mold in perspective and cross-sectional views.
Figure 3B:
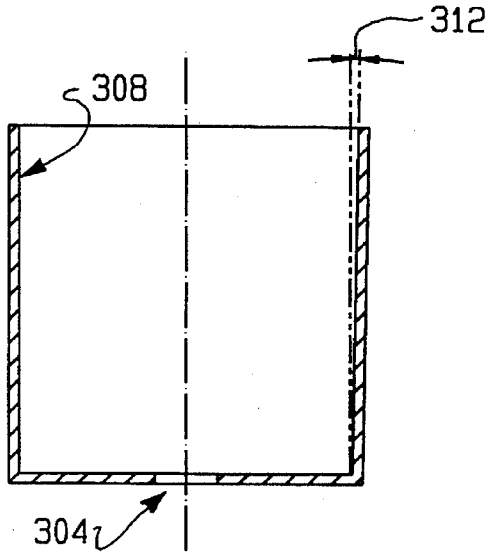

FIGS. 3 to 6 illustrate the mold apparatus used to make the candles of FIGS. 1 and 2. FIG. 3 illustrates the outer mold. This embodiment is substantially cylindrical in shape with a substantially flat bottom and a concentric aperture 304 through the center of the mold bottom. The inner wall 308 of the outer mold in this embodiment is tapered outward approximately 1 to 2 degrees from vertical (see angle 312). This allows the candle to be released easily, yet allows an image to be bottle printed on the outside without substantial misalignment between a graphic applied on the surface and colored layers 200–202. If a design is to be printed on the outer surface of the candle, a taper larger than approximately 5 degrees can cause misalignment of the printed image. However, if only a portion of the entire circumference of the candle is to be later bottle printed, a taper of 15 degrees can be tolerated relatively easily.

The FIG. 3 outer mold is preferably made of a polymer such as polyethylene, polypropylene, or high molecular weight polyethylene. These materials have a thermal expansion coefficient, flexibility and low surface energy that allows the outer shell to be easily removed without marring the final product. They also provide reduced bubble formation, yet hold the product rigidly enough at high temperatures so a consistent, repeatable shape may be produced. The outer mold is preferably transparent, which allows a user to identify problems such as bubble adhesion on the inner surface of the mold as a candle is made, thus allowing the problem to be corrected before the wax cools. Controlling bubble formation is especially critical when multiple layers are being poured in a single mold, as described above, since bubbles tend to adhere to the mold wall at the edge of each successive layer. The transparency of the shell provides a means for monitoring and controlling adhesion between layers and bubble formation on the surface of the mold. Alternatively, the mold can be agitated or oscillated as the wax is poured to dislodge bubbles and improve adhesion. Stirring is also used to control and limit the adhesion of bubbles on the mold. Outer mold transparency further allows the user to accurately determine the level of each individual layer as it is poured in the mold, by filling to predetermined lines marked on the surface of the mold, for example, thus increasing the alignment between the cast layers and the graphic to be applied to the outer surface.

Figure 5:
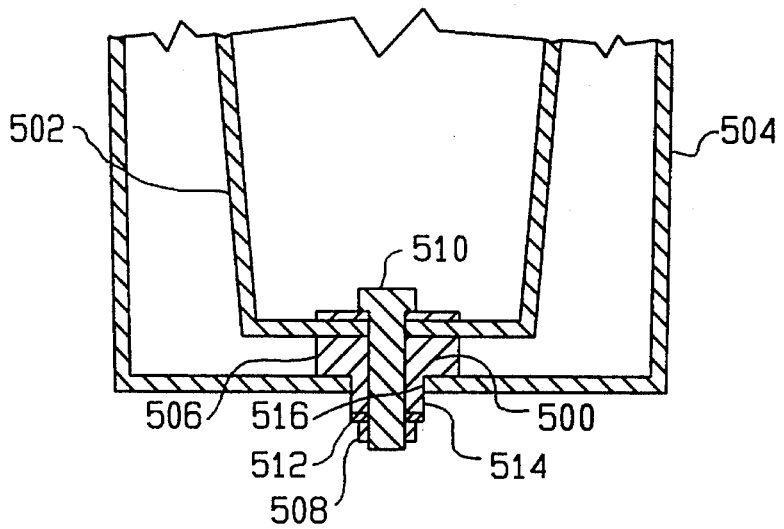
FIG. 5 illustrates a spacer between an inner and outer mold.

The embodiment of the outer mold shown in FIG. 3 has an aperture 304 in the bottom. This aperture serves several purposes. First, it allows an inner mold to be properly oriented and spaced away from the bottom of the outer mold. A flexible bung, discussed below and shown in FIG. 5, is inserted into aperture 304, when the inner and outer molds are assembled, and creates an aperture in the top or first layer of the outer shell called a molded well hole. By molding a well hole the step of drilling a well hole is eliminated.

Figure 4A:
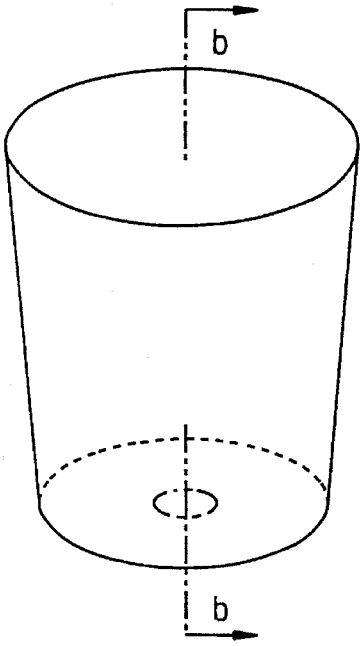
FIGS. 4 (*a*) and (*b*) illustrate an inner mold in perspective and cross-sectional views.
Figure 4B:
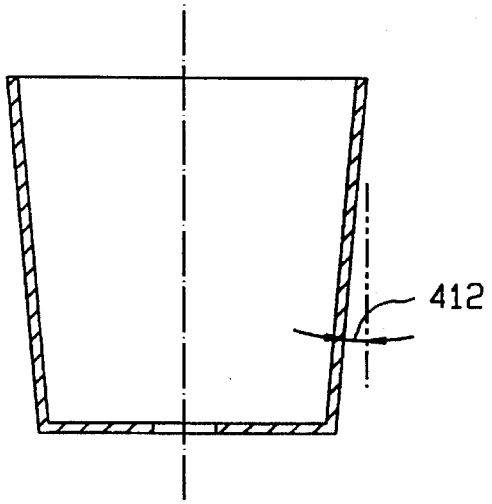

FIG. 4 discloses a preferred embodiment of an inner mold. This mold is preferably a hollow flexible tapered cylinder. The preferred material is a polymer, such as polyethylene, polypropylene, or high molecular weight polyethylene. These materials have the proper thermal expansion coefficient, flexibility and low surface energy to allow easy removal without marring the final product combined with reduced bubble formation and great high temperature support. The inner mold need not be transparent, since it merely defines the shape of the inner core that is typically filled with a lower melting point wax. Since the surface molded by the inner mold is internal to the candle and is ultimately concealed from view by the burnable fill wax, there is no need to determine whether bubbles have formed on the surface. The inner mold is preferably tapered outward to allow easy release of the inner mold from the molded outer shell. Since images are not printed on the inner surface, as they are on the outer surface, the taper of the inner mold can be larger than the taper of the outer mold when the outer surface of the mold is bottle printed. When an inner mold of thin walled polyethylene or high molecular weight polyethylene is used, an inner wall taper 412 of 5–25 degrees from vertical is preferred.

FIG. 5 discloses one embodiment of the spacer (in this case a flexible bung) used to space and join the inner and outer molds. Spacer 500 is preferably made of a low durometer thermally resistant materials such a silicone rubbers, urethanes, neoprenes, styrenes, nitriles, butadienes, or isoprenes. Spacer 500 provides a means for joining inner mold 502 and outer mold 504 as well as a means for spacing the molds a predetermined distance apart, while allowing the molds to shift slightly with respect to each other during cooling, without cracking the outer shell. An additional advantage of the spacer is that it can create a molded well hole at the top of the candle. This well hole is shown as 104 in FIG. 1(*b*) and 206 in FIG. 2(*b*) of the present invention.

Surface 506, that forms the well hole, may have a variety of shapes, such as circles, polygons, or star-like shapes. These shapes would produce a variety of similarly shaped well holes in the top of the outer shell.

Molding the well hole into the top of the outer shell eliminates the step of drilling a well hole into the outer shell. The well hole allows the candle to be filled with the burnable inner core wax to a level slightly below the top surface of the candle. When the burnable core is recessed below the top surface, it will not spill or drip down the outer surface of the candle when lit. The molded well hole also creates an attractive top edge for the outer shell that is spaced away from the inner core which resists burning and preserves the shape of the top of the outer shell, leaving the outer shell intact. The even edge of the well hole allows for easy insertion and removal of replacement candles such as small votive candles. Spacer 500 also allows for easy assembly and disassembly of the molds as well as sealing the holes in the molds from leakage.

The well hole is formed by surface 506 of spacer 500. In the preferred embodiment, the spacer is attached to inner mold 502 by a nut 508 screwed onto a bolt 510. The bung is held between the inner mold 502 and a washer 512. The molds are joined by pressing frictional mating surface 514 through hole 516 in the outer mold. One advantage to threadably mounting the spacer is that the friction fit of the spacer can be varied by varying the compression of washer 512 against bung 500. As the nut is tightened, the washer compresses the bung and frictional mating surface 514 of the bung expands. Using this method of attachment, the diameter of frictional mating surface 514 can be adjusted to provide two conditions: easy separation of the mold halves, and a tight seal to prevent wax from escaping the mold.

An alternative embodiment is to threadably attach the spacer to the outer mold, orient the frictional mating surface upwards, and frictionally attach surface 514 through a hole in the bottom of inner mold 502.

Figure 6:
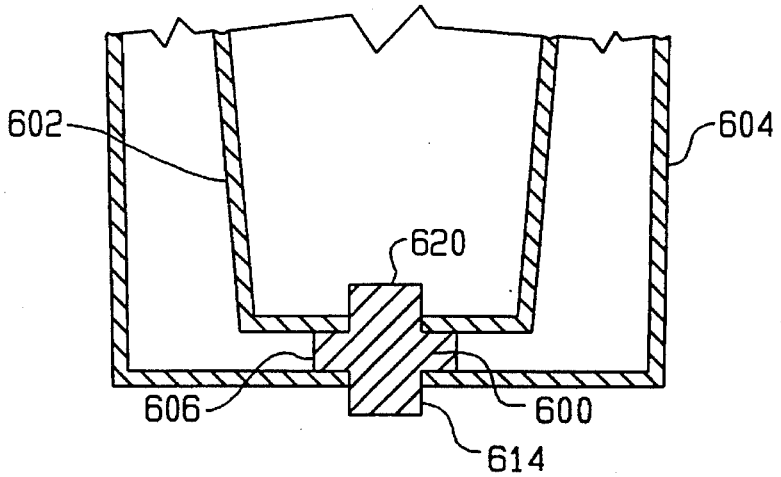
FIG. 6 illustrates another spacer between an inner and an outer mold.

Another embodiment of the spacer eliminates the bolt, nut, and washer of FIG. 5 entirely. This embodiment is shown in FIG. 6. In this embodiment, the spacer 600 is attached to the inner mold and the outer mold by pressing free surface 620 through a hole in the inner mold 602, and by pressing free surface 614 through a hole in the outer mold 604, respectively. Free surface 606 is then oriented between the molds and creates the molded well hole in the molded product.

Large candles can be created with a plurality of molded well holes. A plurality of spacers oriented between the bottoms of the inner and outer molds could be used to create these well holes. Such a plurality of well holes would allow a plurality of wicks to be installed in a single candle, each with its own well hole.

Wax compositions are significant for making a candle with a high melting point outer shell and a low melting point consumable core in accordance with the present invention. They are especially significant when the outer shell is poured in several steps as a series of individual layers. Bubble formation, molten wax viscosity, outer shell durability and cracking during manufacture, and proper knitting of each layer of the outer shell to its adjacent layers are all factors in the design and selection of wax compositions.

The preferred composition for the topmost layer in the candle having the cast top surface and the molded well hole, is as follows:

47% 5055 wax

47% 4045 wax 2.3% Vybar 103 (polyethylene) available from CandleWic of New Britain, Pa.

1.9% 180 degree F. melting point microcrystalline wax)

1.9% Stearic acid (triple pressed)

The above wax mixture is combined with an ultraviolet light absorber also available from CandleWic at the ratio of 1 tsp. absorber to 10 lbs. of wax.

This first composition is preferably poured between 240 and 260 degrees Fahrenheit (preferably 255 degrees Fahrenheit), has a melting point of approximately 148 degrees Fahrenheit and is the most expensive of all the waxes described herein. In the present invention, the wax is preferably heated to 255 degrees Fahrenheit and is used to cast the uppermost layer of the outer shell—the layer that forms the top surface and the molded well hole. Due primarily to this elevated temperature and low viscosity at high temperatures, it creates a molded well hole with very sharp, temperature resistant edges, and dramatically reduces bubble formation on the top surface of the molded product.

Layers of the outer shell that have a larger inner core diameter, and thus are farther from the burning wick, preferably are comprised of a wax with a second composition having a lower melting point. The preferred composition for this portion of the outer shell is as follows:

95% 4045 wax 2.3% Vybar 103

1.9% 180 degree melting point microcrystalline wax 0.9% stearic acid (triple pressed)

The above wax mixture is combined with an ultraviolet light absorber also available from CandleWic at the ratio of 1 tsp. absorber to 10 lbs. of wax.

This second composition is poured at 200 to 230 degrees Fahrenheit, preferably about 215 degrees Fahrenheit, has a melting point of 140–145 degrees Fahrenheit, and is the second most expensive wax in the used in the candle. Its melting point is lower than that of the first composition, yet is still higher than that of the third composition—the consumable fill wax in the inner core of the candle.

The third wax composition is 100% 3035 wax. This composition is used to fill the consumable inner core of the candle. and has a melting point of between 130 and 135 degrees Fahrenheit.

The processes for manufacturing candles according to the present invention have several advantages over the prior art. Unlike the prior art, using the present invention a candle can be cast having a plurality of longitudinally distributed higher melting point colored layers in an outer shell and an inner core of consumable wax. This process avoids prior art steps such as manually arranging colored outer layers or shapes around an inner core then casting them in place. Furthermore, in the present invention, no molds need to be rotated during molding.

The first step in the process is to assemble the inner and outer molds. The inner mold, described above, is treated with a mold release compound on its outer surface and is assembled with the outer mold and spacer as shown in FIGS. 5 or 6. The different waxes are heated in their separate vats and prepared for pouring. A pouring pitcher is filled with the first composition of wax and is poured into the gap between the inner and outer molds where the outer shell is formed. The molds may be entirely filled with a single high melting point temperature wax, or they may be filled with a first layer of a high melting point composition, such as the first composition herein described, preferably to a level that just covers the bottom of the outer mold and just touches the bottom of the inner mold (layer 200 in FIG. 2). This height is shown as level 608 in FIG. 6. A layer comprised of the first composition provides the high heat protection from the burning wick and bubble prevention for what will be the top surface of the candle.

After the first layer is poured, it preferably should partially solidify and reach a core temperature of 135 to 140 degrees Fahrenheit before additional layers are poured (if more than one shell layer is to be poured). It has been determined that when the first layer is at this temperature, it is soft enough to melt and bond or "knit" to the next layer to be poured, but is hard enough not to melt significantly and cause the colors of adjacent layers to bleed together, which would destroy the purity of the multilayered multicolored visual effect described above. Forty-five minutes has been determined to be the optimum cooling time for each of the layers of the outer shell if the ambient temperature is 75 degrees. As the first layer cools and shrinks, the polyethylene outer mold shrinks along with it, preventing a gap from forming between the outer shell and the outer mold. This is of particular advantage when several layers are successively poured in an outer mold, for once the outer shell shrinks away from the outer mold walls, the next layer poured may infiltrate between the previously cast portions of the outer shell and the outer mold, leaving an unsightly and irregular line dividing the two layers. A rigid mold that does not contract as it cools will not protect against this infiltration as well as polymer molds.

After cooling forty-five minutes at approximately 75 degrees Fahrenheit ambient temperature, the remaining layers can be poured, preferably of the second composition, and again with a cool-down period between each layer. Once the last layer is poured, a cool-down period of one hour and fifteen minutes is appropriate. After this cool-down, a noticeable depression will appear on the top surface of the outer shell. This depression should be filled with wax until the wax is flush with the top of the mold.

After a ten minute wait the inner mold should be separated from the product. This step is especially important to prevent the outer shell from cracking as it cools and contracts around the inner mold. The risk of cracking is reduced since the polymeric inner mold contracts as the wax cools. The risk is not entirely eliminated, however. A shell should be thick enough to limit cracking, yet thin enough to allow light to glow through the shell. Shells that are between 10 and 40 percent of the radius of the candle are preferred in this regard. Most preferable are shells with a thickness of 15–25 percent of the candle radius.

After an additional 30 minute wait, the outer shell can be removed from the outer mold. At this point a solid shell of wax with a hole at the bottom (the molded well hole) remains.

An alternative method for producing the outer shell is to cast a solid candle body using an outer mold and not an inner mold. Using this method, successive layers are cast as described above, but rather than creating a hollow outer shell, a solid candle body is created.

After casting and cooling the layers, the inner core is created by drilling the solid candle body with two different diameter drills. A first drill having a large drill diameter is used to drill a hole from the bottom of the candle body to a point proximate to (but not piercing) the top of the solid candle body. This hole forms the larger diameter portion of the inner core. A second drill having a smaller diameter is then used to create the well hole at the top of the candle. At this point, the drilled outer shell is similar to the molded outer shell. It has a well hole aperture at the top of the outer shell and a larger diameter aperture extending from the well hole aperture to the bottom of the outer shell.

Figure 7:
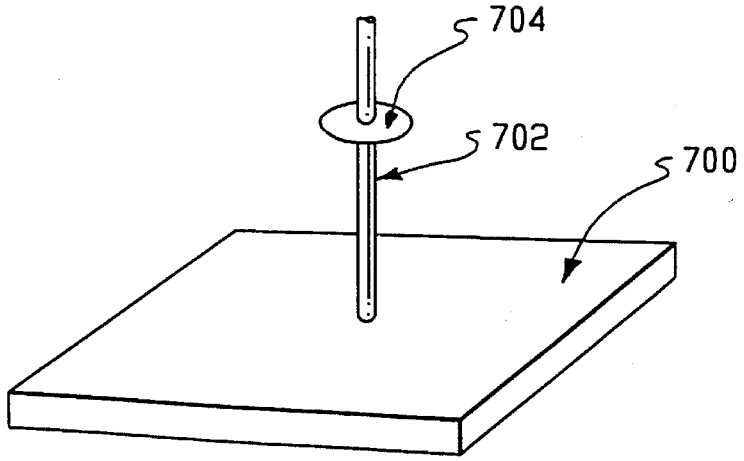
FIG. 7 illustrates a flattener in a perspective view.

After forming the outer shell, the next step involves flattening and sealing the bottom of the outer shell. A special flattening plate for flattening the base is illustrated in FIG. 7. A preferred embodiment of the flattening plate comprises a heated plate 700, with a means for positioning the candle 702, 704 above the heated plate. In the FIG. 7 embodiment, the means for positioning includes a substantially vertically extending elongated member 702 superposed with an outer shell support 704. Support 704 is preferably both adjustably and threadably mounted to elongate member 702, such that the vertical distance between support 704 and heated plate 700 may be varied. The outer shell support is designed to fit as closely as possible to the bottom of the shell. In use, the outer shell is inverted (well hole oriented upwards) and is lowered onto the outer shell support. If the outer shell is too tall for proper alignment with the image to be printed on the outer surface, the rim of the outer shell will touch the heated plate before the top layer of the outer shell rest upon the outer shell support. In practice, the rim of the outer shell melts on the heated plate and the outer shell gradually sinks until the outer shell is supported by the outer shell support. To provide the outer shell with a superior and more square base for more accurate printing, the outer shell can be gently rotated as it sinks.

Flattening the outer shell insures that the height of each outer shell is standard. A uniform height is important when an image is printed on the candle at a later stage. If the candles are not equal in height, the graphics on each will not properly line up with the colored layers of the outer shell to create the synergistic effect of colored layers and graphics described above.

Once the outer shell has been flattened, it is sealed on the bottom. Ordinarily the outer shell would have no molded well hole and would therefore form a cup shape. This shape could be easily inverted and filled with wax. With a molded well hole, however, a different technique is required.

The outer shell is lifted off the flattener, is placed upright (well hole upwards) and pressed firmly on a flat surface. In a preferred embodiment, the flat surface is covered with a greasy material that serves to seal the base of the outer shell, preventing fill wax from leaking out, and serves as a mold release agent. Once placed on the flat surface, a layer of high melting point wax (preferably of the same composition as the bottom of the shell) is poured through the well hole to seal the bottom of the shell and provide a hard durable surface for the base.

A graphic is next placed on the outer surface of the outer shell. As explained above, this step can involve printing or applying a decal or other applique. Bottle printing machines are especially effective in printing the surface of the outer shell. These machines are adapted to print labels or designs on cylindrical glass or plastic bottles. Even though candles do not have a glass or plastic surface, applicants have found them to be particularly effective in candle printing. Applicants have identified special inks that bond well with a wax surface and may be readily applied with a bottle printing machine. Printing inks preferred for the bottle printing process are the 9700 series inks by Nazdar, Inc.

Once the image is printed on the surface of the outer shell, it is preferably "overdipped" with a layer of high melting point wax (such as beeswax, or bleached beeswax, for example) to seal the image and prevent the image from being smeared, smudged, scratched or scraped off. If the outer shell is comprised of a series of differently colored bands, the best practice is to overdip the outer shell with a layer of clear wax. The outer shell is supported by the well hole and is quickly lowered into a vat of molten wax. The outer shell need not stay in the wax longer than a second in order to be completely coated. If it remains in the vat any longer, the printed or applied image may begin to come off.

After this overdipping, the outer shell is allowed to cool on a flat surface. Optionally, it may be gently spun to remove excess molten wax and to prevent drips of overdip wax from forming on the outer surface.

Once the overdip wax has solidified, the consumable low melting point fill wax (the third composition, above) can be added. Before the fill wax is added, however, it is advisable to preheat the outer shell to prevent cracking due to thermal stress. Typically, the outer shells are placed in a chamber heated between 80 and 120 degrees Fahrenheit (preferably 80 degrees Fahrenheit for molten fill wax at 140 degrees Fahrenheit) and are allowed to equalize to that temperature.

After preheating, the shells are filled with fill wax until the top surface of the fill wax is preferably between 0.2 and 0.5 inches below the top surface of the outer shell. The fill wax is then allowed to cool and solidify. The top surface of the solidified fill wax may then pierced to open up an internal void that is often formed when the fill wax solidifies and shrinks. This void is then filled with the fill wax.

Approximately 30 minutes later after the newly added fill wax has cooled and solidified, a hole is made in the fill wax, preferably down the center of the well hole, and the wick is inserted. This wick is then sealed in place by pouring a small amount of fill wax into the well hole around the wick. The candle is now complete.

We claim the following:

1. A method of casting a candle comprising the steps of:

casting a first layer of an outer shell of said candle from a first wax material having a first melting point;

casting a second layer of said outer shell from a second wax material having a second melting point, wherein said second layer is in contact with said first layer, and wherein said second melting point is less than said first melting point;

casting an inner core of said candle inside said inner shell from a third wax material having a third melting point, wherein said third melting point is less than said second melting point.

2. The method set forth in claim 1 further comprising the step of casting a base in said outer shell before said step of casting an inner core.

3. The method set forth in claim 1 further comprising the step of heating said first wax material to a temperature between 240 and 260 degrees Fahrenheit before said step of casting said first layer.

4. The method set forth in claim 1 further comprising the step of heating said second wax material to a temperature between 200 and 230 degrees Fahrenheit before said step of casting said second layer.

5. The method set forth in claim 2 further comprising the step of flattening the bottom of said outer shell before said step of casting a base.

6. The method set forth in claim 1 further comprising the step of printing an image on the surface of said outer shell, wherein said image is aligned with said first and second layers.

7. The method of claim 1 further comprising casting the layers in a mold, wherein the mold comprises:

an outer mold having an inner surface for forming an outer surface of such outer shell;

an inner mold having an outer surface for forming an inner surface of said outer shell, disposed inside of said outer mold and substantially spaced apart from said inner wall of said outer mold; and a spacer for spacing apart said inner mold and said outer mold, said spacer extending between the bottom of said inner mold and the bottom of said outer mold, and having a smaller cross sectional area than the area of the bottom of said inner mold.

8. The method of claim 7 further comprising selecting the outer mold of a clear polymeric material.

9. The method of claim 8 further comprising selecting the clear polymeric material to be polyethylene.

10. The method of claim 7 further comprising tapering the outer mold between about 1 and 15 degrees.

11. The method of claim 7 further comprising selecting a bung passing through the bottom of said outer mold as the spacer.

12. The method of claim 11 further comprising selecting the bung to be of a low durometer polymeric material.

13. The method of claim 7 further comprising selecting means for spacing to be substantially concentric with the inner and the outer molds.

14. The method of claim 1 further comprising adjusting the bung to provide a variable friction fit between the bung and the aperture in the bottom of the outer mold.

15. The method of claim 14 further comprising varying the variable friction fit by tightening a screw fastener.

16. The method of claim 5 wherein the flattening step is conducted using a flattener which comprises:

a heatable plate;

an elongate member connected to said heatable plate and extending substantially vertically above said heated plate;

a candle support mounted to said elongate member having a top surface adapted to support said outer shell.

17. The method of claim 16 which further comprises adjusting the distance between the candle support and the heatable plate to modify the area that is flattened.

18. The method of claim 1 which further comprises forming the outer shell as a series of layers of different colored wax materials.

19. The method of claim 18 which further comprises retaining the first layer of the outer shell at a temperature which is sufficiently soft to allow the wax material of the first layer to melt and bond to the second layer but which is below that which would cause the colors of the layers to bleed together.

20. The method of claim 18 which further comprises applying an image or graphic to one of the colored layers of the outer shell.

21. The method of claim 20 which further comprises protecting the image with a coating to prevent smearing, smudging or scratching of the image.

22. The method of claim 1 which further comprises casting the layers of the outer shell as a solid component and drilling at least one hole in the solid component before casting the inner core therein.

23. The method of claim 22 wherein a first hole is drilled to form the inner core and a second hole is drilled to form a well hole for the wick.

* * * * *